United States Patent [19]

Takeda

[11] Patent Number: 4,903,013

[45] Date of Patent: Feb. 20, 1990

[54] DISPLAY SYSTEM FOR PLURAL DISPLAY AREAS ON ONE SCREEN

[75] Inventor: Susumu Takeda, Kasugai, Japan

[73] Assignee: Brother Kogyo Kabushiki Kaisha, Aichi, Japan

[21] Appl. No.: 139,809

[22] Filed: Dec. 30, 1987

[30] Foreign Application Priority Data

Jan. 7, 1987 [JP] Japan ..... 62-1454

[51] Int. Cl.[4] ..... G09G 1/06

[52] U.S. Cl. ..... 340/726

[58] Field of Search ..... 340/721, 723, 724, 726; 364/521

[56] References Cited

U.S. PATENT DOCUMENTS

| | | | |
|---|---|---|---|
| 4,375,638 | 3/1983 | O'Keefe et al. | 340/726 |
| 4,386,410 | 5/1983 | Pandya et al. | 364/521 |
| 4,412,294 | 10/1983 | Watts et al. | 340/726 |
| 4,491,834 | 1/1985 | Oguchi | 340/726 |
| 4,527,154 | 7/1985 | Tanaka | 340/721 |
| 4,594,587 | 6/1986 | Chandler et al. | 340/750 |
| 4,618,858 | 10/1986 | Belch | 340/721 |
| 4,706,076 | 11/1987 | Racchini | 340/726 |

FOREIGN PATENT DOCUMENTS

| | | | |
|---|---|---|---|
| 149788 | 7/1985 | European Pat. Off. . | |
| 206328 | 12/1986 | European Pat. Off. . | |
| 0044626 | 3/1980 | Japan | 340/726 |

OTHER PUBLICATIONS

Patent Abstracts of Japan, vol. 7, No. 266 (P239) 26th Nov. 1983; & JP-A-58 146 930 (Hitachi Seisakusho KK) 1/9/83.

*Primary Examiner*—Gerald Brigance
*Assistant Examiner*—Richard Hjerpe
*Attorney, Agent, or Firm*—Oliff & Berridge

[57] ABSTRACT

A display system for displaying characters on a screen which is divided into a plurality of display areas and for allowing a scroll within each of the display areas with one chip of display data RAM without image confusion between the display area. The display data RAM is also divided into plural areas corresponding to the display areas. This system includes address conversion circuit provided between a display controller and the display data RAM for converting a virtual address outputted from the display controller into an actual address of the display data RAM. Here the virtual address is an address out of actual address of the display data RAM.

3 Claims, 4 Drawing Sheets

DISPLAY SYSTEM FOR PLURAL DISPLAY AREAS ON ONE SCREEN

BACKGROUND OF THE INVENTION

The present invention relates to a display system for a computer or word processor using a display screen which is divided into a plurality of display areas where different images are respectively displayed.

For scrolling an image (including characters and figures) on a display screen, conventional display system shifts a start address at which data is started to be read out from a display data RAM by a preset amount (corresponding to one line). When the display screen is divided into two areas and the display image in each area is to be scrolled, the following drawback occurs. When the sets of the display data for each divided area of the screen are both stored in one display data RAM and the starting address for reading out data is shifted greatly for scrolling, data of the other area of the screen will be read out. This causes confusion between the areas of the screen when scrolling. To avoid this confusion, respective display data RAMs are provided for respective areas of the screen, which leads to drawbacks of complicated configuration of the circuit board, increased the size of the board and subsequently vulnerability to electrostatic noise and AC line noise.

One method for avoiding the increase in the number of display data RAMs for respective scrolling of plural areas of a display is to completely rewrite the content of one area of a display data RAM shared by the plural areas by using the cycle stealing method. Every time a scroll is desired in the display of one of the areas, the whole content of the area of the display data RAM is completely rewritten. But this method has its own drawback that the working time of the CPU for rewriting the content of the area of the RAM is long and accordingly other processes to be executed by the CPU are delayed. Further, a latching circuit is needed to execute the cycle stealing method and the display data RAM having responsiveness higher than a normal RAM is needed in order to shorten the rewriting time.

SUMMARY OF THE INVENTION

Accordingly an object of the invention is to provide a display system in which only one display data RAM is utilized to display characters in plural areas of a screen and the display in each area can be scrolled.

Another object of the invention is to reduce the number of RAM needed to store data for plural areas of a screen and to simplify the circuit construction to make the circuit less affected by noise.

Still another object is to facilitate the rewriting of display data without utilizing the cycle stealing technique which imposes a heavy load on the CPU and delays other processings executed by the CPU.

These and other objects are achieved by the display system of the present invention for displaying characters on a screen which is divided into a plurality of display areas and for allowing a scroll within one of the display areas, which comprises:

display data memory means for storing character data to be displayed on the screen, the display data memory means being divided into a plurality of memory areas each corresponding to respective display areas;

display control means for sequentially outputting addresses to each of the memory areas of the display data memory means in order to output the character data of the display data memory means designated by the addresses to each of the display areas of the screen corresponding to said each of the memory areas of the display data memory means; and address conversion means provided between the display control means and the display data memory means for converting a virtual address outputted from the display control means into an actual address of said one of the memory areas of the display data memory means, the virtual address being an address out of actual address of said one of the memory areas.

BRIEF EXPLANATION OF THE DRAWINGS

The invention may be best understood by referring to the following description of the preferred embodiment and the drawings in which.

DETAILED DESCRIPTION OF THE PREFERRED EMBODIMENT

Figure 2:
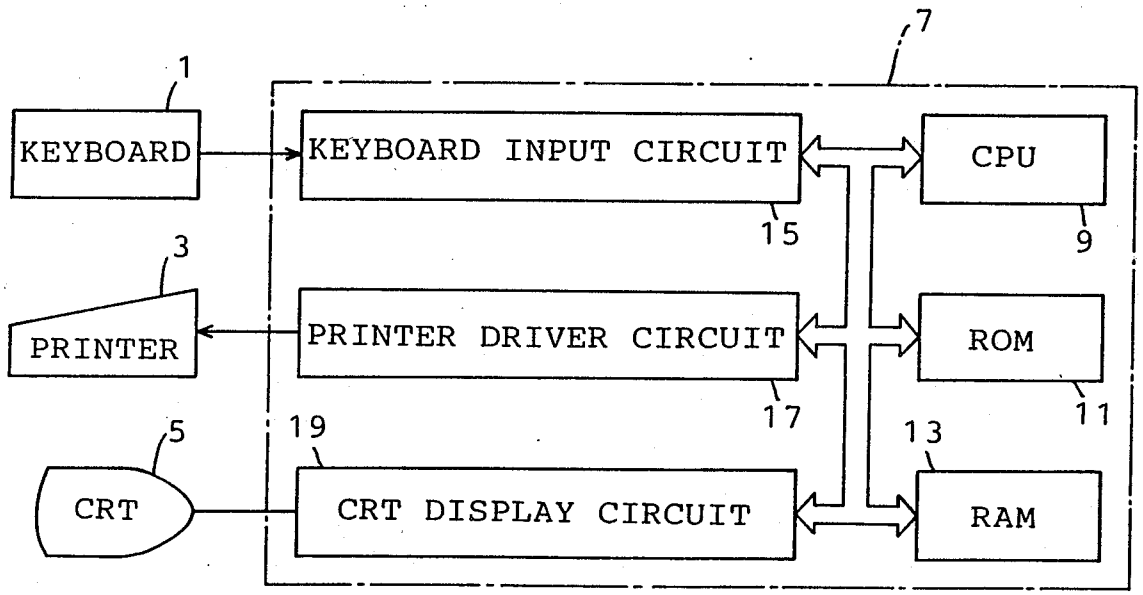
FIG. 2 is a structural block diagram of a word processor of the embodiment.

The present invention is embodied in a word processor. As shown in FIG. 2, a word processor of the embodiment includes a keyboard 1, printer 3, CRT 5 and an electronic control unit 7. The electronic control unit 7 is connected to the keyboard 1, printer 3 and CRT 5; and it executes processings including inputting, editing, displaying and printing of texts. The electronic control unit 7 is constructed as a logical circuit equipped with: CPU 9 which executes above processings; ROM 11 which stores control programs for performing above processings and various preset data; RAM 13 which stores text data and temporary data necessary for the control of the processings; a keyboard input circuit 15 which is connected to the keyboard 1; a printer driver circuit 17 which is connected to the printer 3; and a CRT display circuit 19 which is connected to the CRT display 5.

Figure 1:
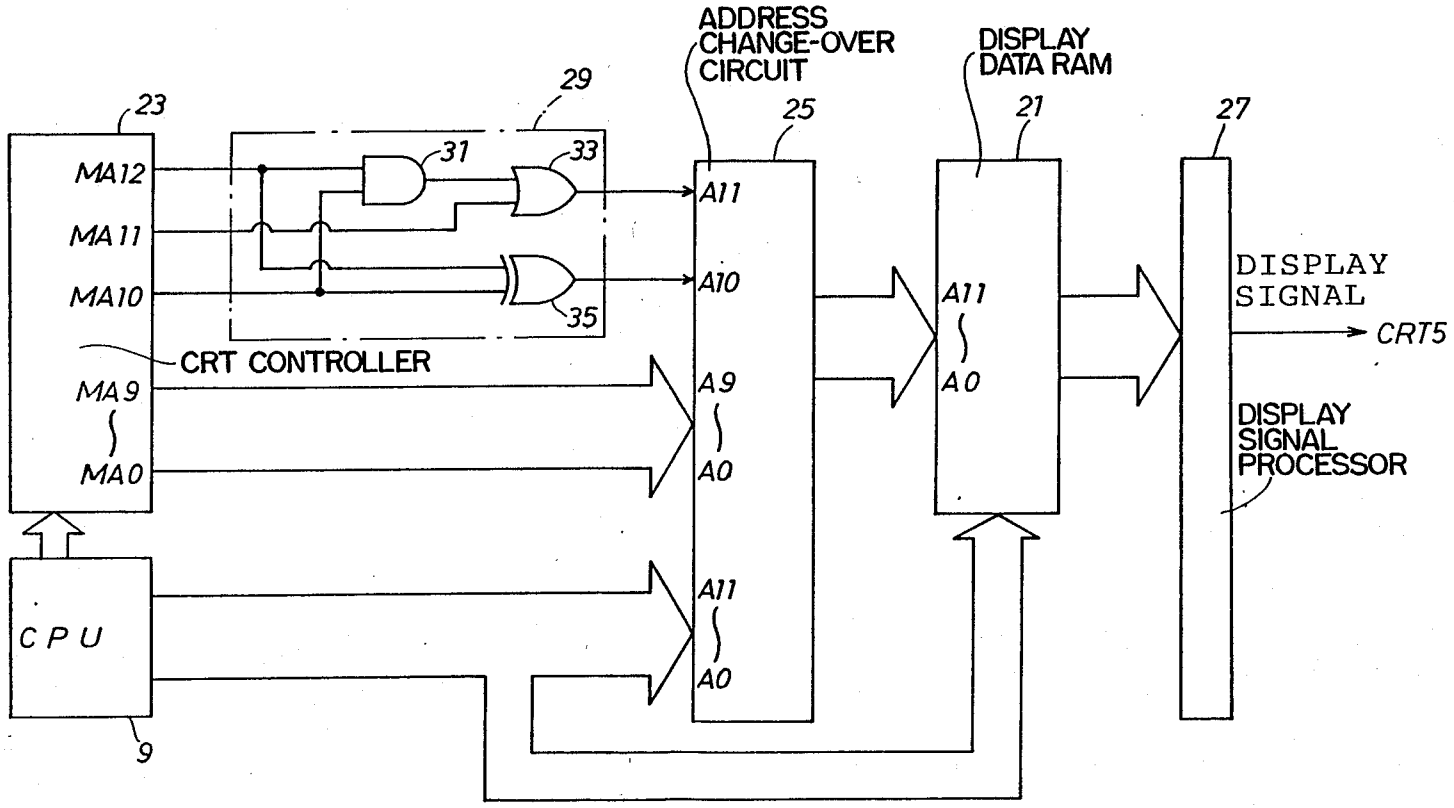
FIG. 1 is a block diagram of a CRT display circuit of an embodiment of the invention.

As shown in FIG. 1, the CRT display circuit 19 includes: display data RAM 21 which stores data to be displayed on the CRT 5; and a CRT controller 23 which outputs address data to the display data RAM 21 and makes the display data RAM 21 output display data corresponding to the address data. This CRT display circuit 19 is designed such that, when the CPU 9 outputs a start address along with a definite amount of address data corresponding to necessary data to be put on the display screen (CRT) to the CRT controller 23, an amount of data in the display data RAM 21 corresponding to the amount of the address data is outputted to the CRT 5. On the line from the CRT controller 23 to the display data RAM 21 is provided an address signal change-over circuit 25 which switches an address signal inputted into the display data RAM 21 from that from the CRT controller 23 to that from the CPU 9. When the CPU 9 outputs address data to the display data RAM 21, the signal change-over circuit 25 switches the input from that from the CRT controller 23 to that from the CPU 9 and outputs the address data from the CPU 9 to the display data RAM 21. Therefore, when an item of the display on the CRT 5 is to be changed, the CPU 9 designates a specific address of the display data RAM 21 to rewrite the data item at the specific address.

Figure 3A:
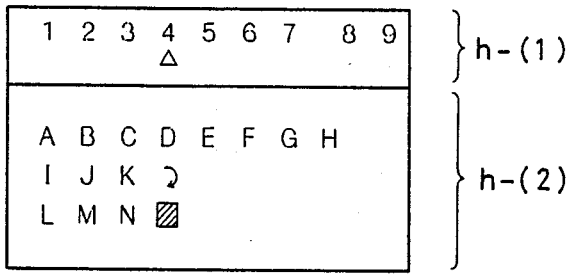
FIGS. 3A and 3B are examples of a display screen divided into two areas and FIG. 3A shows the upper and lower areas before scrolling and FIG. 3B shows them after scrolling.
Figure 3B:
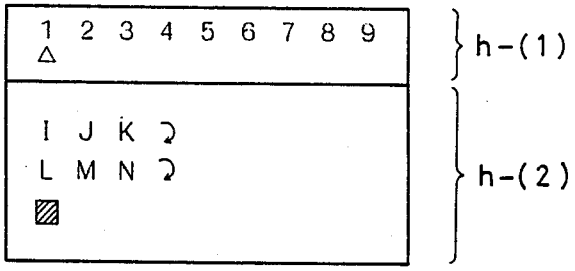
Figure 4:
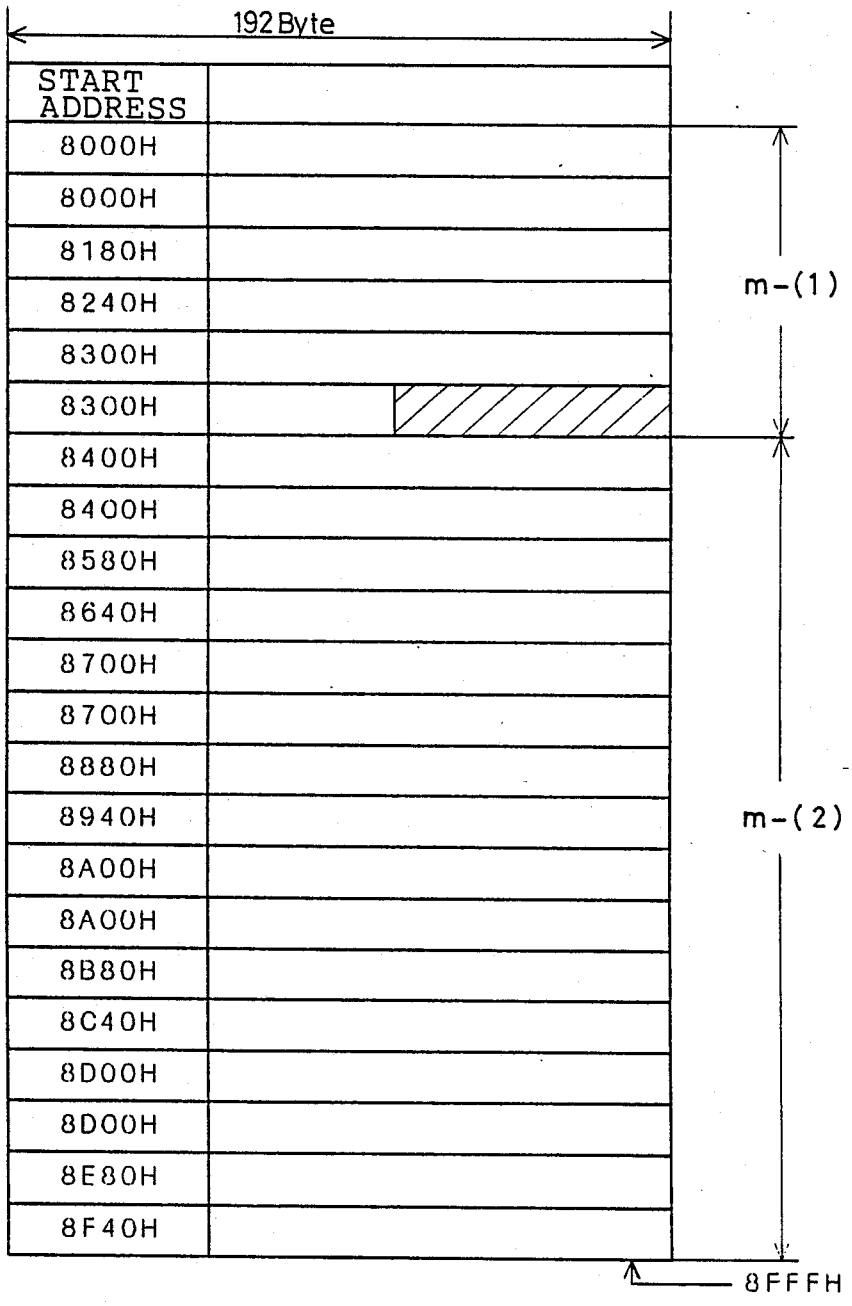
FIG. 4 is a diagram showing the structure of the display data RAM.

In this embodiment, as shown in FIGS. 3A and 3B, the display screen on the CRT 5 is divided into two areas, h-(1) and h-(2), and correspondingly, the memory region of the display data RAM 21 is, as shown in FIG. 4, also divided into two areas, m-(1) and m-(2), in order to change or scroll the images on respective areas of the screen independently like from FIG. 3A to FIG. 3B. The data in the area m-(1) in the display data RAM 21 corresponds to the image on the upper area h-(1) of the CRT 5 and m-(2) to h-(2). So, when two images are displayed on the respective areas of the CRT 5, two sets of the necessary amount of address data to be displayed in the respective areas, h-(1) and h-(2), of the CRT 5 are inputted into the respective areas, m-(1) and m-(2), of the display data RAM 21. As shown in FIG. 4, a 4 k-byte RAM is employed for the display data RAM 21 in the embodiment and the memory region is divided into lines, each line having 192 byte space. 6 lines are provided for the memory area m-(1) and 16 lines are provided for m-(2). Among 6 lines provided for the memory area m-(1), 2 lines are output on the upper area h-(1) of the CRT 5. Among 16 lines of the memory area m-(2), three lines are output on the lower area h (2) of the CRT 5. Thus, the content of the display data RAM 21 is displayed respectively on the upper and lower areas h-(1) and h-(2) of the CRT 5.

The display data outputted from the display data RAM 21 are inputted into a display signal processor 27 where the display data are processed to produce a signal appropriate for the display on the CRT 5. In this embodiment, only the lower area h-(2) of the CRT screen is scrolled, as shown in FIG. 3A and 3B, while the upper area h-(1) is not scrolled but only the cursor (shown by a triangle) is moved in the area. Therefore only two lines of addresses are utilized in the memory area m-(1).

When two images are to be displayed in the two areas h-(1) and h-(2) of the CRT 5, respective address data are input from the CRT controller 23 to the display data RAM 21 via the address change-over circuit 25. As different RAM chips are not prepared in this embodiment for the two display areas h-(1) and h-(2) but only one chip is provided for the two areas and the memory areas m-(1) and m-(2) are continuing in the one chip, the following problem occurs. When CPU 9 simply designates the two start addresses of the display data and respective definite amounts of following address data for reading out the display data for respective areas h-(1) and h-(2) from the display data RAM 21, it may happen that the data to be displayed in the area h-(1) is displayed in the area h-(2) because data in the area m-(1) is, in some cases, read out during display of area h-(2). Namely, when the image of the lower area h-(2) is scrolled, as shown by FIGS. 3A and 3B, by an instruction from the keyboard 1 and a start address 8E80H (H shows number in hexadecimal expression) is designated by the CPU 9 for the display of the data area m-(2), display data corresponding to the last (third) line of the lower area h-(2) is outputted from the first line of memory region of the display data RAM 21 which is a data line starting at address 8000H in the area m-(1). This causes a confusion of images between the display areas h-(1) and h-(2).

For avoiding the above problem, the embodiment of the present invention adopted the system as set forth. The CRT controller 23 outputs a number of bits (13) as an address data to the display data RAM 21 which is more than the number of bits (12) necessary to address the display data RAM 21. The upper 3 bits of the 13 bits are converted into 2 bits by an address conversion circuit 29 and the 2 bits are inputted into the display data RAM 21. The address conversion circuit 29 is constructed from an AND circuit 31, an OR circuit 33 and an EXclusive-OR circuit 35. As the three logical circuits in the address conversion circuit 29 are connected as shown in FIG. 1, the relationship between the three inputs and two outputs of the address conversion circuit 29 is as shown in Table 1. The three inputs come from the CRT controller 23 and the two outputs go to the display data RAM 21.

TABLE 1

| OUTPUT OF CRT CONTROLLER | | | INPUT OF DIS-DATA RAM | |
|---|---|---|---|---|
| MA12 | MA11 | MA10 | A11 | A10 |
| 0 | 0 | 0 | 0 | 0 |
| 0 | 0 | 1 | 0 | 1 |
| 0 | 1 | 0 | 1 | 0 |
| 0 | 1 | 1 | 1 | 1 |
| 1 | 0 | 0 | 0 | 1 |
| 1 | 0 | 1 | 1 | 0 |
| 1 | 1 | 0 | 1 | 1 |
| 1 | 1 | 1 | 1 | 0 |

As the upper three bits of the address data outputted from the CRT controller 23 are converted into two bits shown in Table 1, the address outputted from the CRT controller 23 is converted into the address to be inputted in the display data RAM 21 as shown in Table 2.

TABLE 2

| ADDRESS FROM CRT CONTROLLER | ADDRESS INTO DISPLAY RAM |
|---|---|
| 8000-83FF | 8000-83FF |
| 8400-87FF | 8400-87FF |
| 8800-8BFF | 8800-8BFF |
| 8C00-8FFF | 8C00-8FFF |
| 9000-93FF | 8400-87FF |
| 9400-97FF | 8800-8BFF |
| 9800-9BFF | 8C00-8FFF |
| 9C00-9FFF | 8800-8BFF |

Even if the address outputted from the CRT controller is greater than 9000, a virtual address which actually does not exist in the memory areas of the display data RAM 21, the address data inputted in the display data RAM 21 designates from the first address 8400 of the lower area m-(2) of the display data RAM 21. This prevents data in the m-(1) area from being displayed in the lower area h-(2) and prevents confusion between the display areas h-(1) and h-(2).

Think of a situation in which an operator is making a text on the screen, he or she scrolls the display image of the lower area of the screen, as shown in FIGS. 3A and 3B, and the bottom line in the lower display area h-(2) reaches the data of the last line of the area m-(2). During text making, the data line of the memory area m-(2) corresponding to the last line of the area h-(2) is rewritten by the operator and, when the input in the last line is finished, the image in the area h-(2) is scrolled up to make a new line. When the text inputting in the last line of the memory area m-(2) is finished, the next new line to be inputted will be the first line of the memory area m-(2). At this time, the start address for displaying the area h-(2) is 8E80 in the memory area m-(2) and, for the last line of the area h-(2), addresses of 192 bytes starting from the address 9000 in the memory area m-(2) are designated by the CRT controller 23. This address data starting from 9000 is converted by the address conversion circuit 29 into the address data starting from 8400, which enables normal display on the display area h-(2).

In this embodiment, when the start address outputted from the CPU 9 to the CRT controller 23 reaches the virtual address region (which is over 9000), the CPU 9 alters the output start address from within the virtual region to the actual address in the memory region m-(2) (8400 - 8FFF) during the vertical retrace period of the CRT display 5.

As described above, the CRT controller 23 is designed in this embodiment so as to output more number of bits as an address data for designating the display data RAM 21 to display on the CRT 5 and, when a virtual address which actually does not exist in the actual memory area m-(2) is outputted from the CRT controller 23, the virtual address is converted into the actual address in the memory area m-(2) of the display data RAM 21, and is inputted into the display data RAM 21. Therefore, different memory RAM chips are not needed for the divided areas h-(1) and h-(2) of the CRT display 5 when it is desired to scroll each of the images on the areas h-(1) and h-(2) independently without confusion. Further, when it is desired to change a data item on the display, the whole area h-(2) of the screen on the CRT display 5 need not be changed by the cycle stealing method, but it is sufficient to change only the line to which the data item belongs. Then, when the start address and necessary amount of addresses to follow are designated by the CPU 9, the image on the CRT 5 is changed, which avoids any burden otherwise imposed on the CPU 9.

In the description of the above embodiment, though the image on the upper area h-(1) is not scrolled for reasons of simplicity of explanation, it is easy to make the upper area h-(1) scroll as well in the following manner. When it is desired to scroll the image on the upper area h-(1), another address conversion circuit (not shown) is needed between the CRT controller 23 and the address change-over circuit 25. In this case, this address conversion circuit converts addresses from 8400 to 87FF into those from 8000 to 83FF in the actual memory area of m-(1). This time, the above address conversion circuit for the lower area h-(2), m-(2) are so arranged that addresses over 8800 are converted into addresses from 8400 and after in the same manner. By these measures, the images on respective areas h-(1) and h-(2) are scrolled without interfering with each other.

Obviously, many modifications and variations of the present invention are possible in light of the above teachings. It is therefore to be understood that within the scope of the appended claims, the invention may be practiced otherwise than as specifically described. For example, the display screen on the CRT 5 can be divided into more than two areas by providing an address conversion circuit similar to that of the present invention.

What is claimed is:

1. A display system for displaying characters on a screen which is divided into a plurality of display areas and for allowing a scroll within each of the display areas, comprising:

display data memory means for storing character data to be displayed on the screen, the display data memory means being divided into a plurality of memory areas each corresponding to a respective display area;

display control means for sequentially outputting addresses in order to output the character data of the display data memory means designated by the addresses to each of the display areas of the screen corresponding to respective memory areas of the display data memory means, wherein a first number of address designation lines of the display control means is greater than a second number of address designation lines of the display data memory means; and address conversion means including a logic circuit provided between the display control means and the display data memory means for converting said first number of addresses outputted from the display control means into said second number of addresses of the display data memory means, said logic circuit receiving a select number of said first number of address designation lines and outputting less than said select number of said second number of address designation lines, whereby any virtual address outputted from said display control means is converted into an actual address of the memory areas of the display data memory means, the virtual address being greater than any of the actual addresses of the display data memory means.

2. A display system for displaying characters on a screen which is divided into a plurality of display areas and for allowing a scroll within each of the display areas, comprising:

display data memory means for storing character data to be displayed on the screen, the display data memory means being divided into a plurality of memory areas each corresponding to a respective display area;

display control means for sequentially outputting addresses in order to output the character data of the display data memory means designated by the addresses to each of the display areas of the screen corresponding to respective memory areas of the display data memory means, wherein a first number of address designation lines of the display control means is greater than a second number of address designation lines of the display data memory means; and address conversion means provided between the display control means and the display data memory means for converting said first number of addresses outputted from the display control means into said second number of addresses of the display data memory means whereby any virtual address outputted from said display control means is converted into an actual addresses of the memory means of the display data memory means, the virtual address being greater than any of the actual addresses of the display data memory means, said address conversion means including a logic circuit receiving inputs of a select number of said first number of address designation lines and outputting less than said select number of said second number of address designation lines; and control means for outputting a start address and an amount of following addresses designating a part of an area of the display data memory means to the display control means in order to display characters of the part and for rewriting contents of the display data memory means and shifting the start address by an amount corresponding to one line for scrolling the display area of the screen by one line.

3. The display system according to claim 2, wherein when the start address is a virtual address, the control means changes the start address from the virtual address to the actual address corresponding to the virtual address.

* * * * *